US007396254B2

(12) United States Patent
Harmelink et al.

(10) Patent No.: US 7,396,254 B2
(45) Date of Patent: Jul. 8, 2008

(54) FLEXIBLE ELECTRICAL CONNECTOR/HOUSING ASSEMBLY

(75) Inventors: Gregory Keith Harmelink, Moorhead, MN (US); Michael Ray Schlichtmann, Fargo, ND (US); Kevin Park Cowles, Fargo, ND (US); Jon Thomas Jacobson, Fargo, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/434,341

(22) Filed: May 15, 2006

(65) Prior Publication Data

US 2007/0264867 A1 Nov. 15, 2007

(51) Int. Cl.
*H01R 13/60* (2006.01)

(52) U.S. Cl. ..... 439/540.1; 439/572; 439/76.1; 439/686

(58) Field of Classification Search ..... 439/540.1, 439/572, 76.1, 686, 587
See application file for complete search history.

(56) References Cited

U.S. PATENT DOCUMENTS

| | | | | | |
|---|---|---|---|---|---|
| 3,711,817 | A * | 1/1973 | Carter et al. | ..... | 439/272 |
| 3,803,531 | A * | 4/1974 | Sorensen | ..... | 439/190 |
| 4,249,788 | A * | 2/1981 | McNeel | ..... | 439/272 |
| 4,960,391 | A * | 10/1990 | Beinhaur et al. | ..... | 439/559 |
| 5,473,509 | A | 12/1995 | Schoettl et al. | ..... | 361/715 |
| 5,636,998 | A | 6/1997 | Daly et al. | ..... | 439/76.1 |
| 5,671,122 | A | 9/1997 | Schoettl et al. | ..... | 361/715 |
| 5,967,802 | A | 10/1999 | Daly et al. | ..... | 439/76.1 |
| 6,077,102 | A | 6/2000 | Borzi et al. | ..... | 439/364 |
| 6,155,842 | A | 12/2000 | Baitz | ..... | 439/61 |
| 6,413,108 | B2 | 7/2002 | Centofante | ..... | 439/267 |
| 6,413,119 | B1 | 7/2002 | Gabrisko, Jr. et al. | ..... | 439/620 |
| 6,549,426 | B1 | 4/2003 | Lawlyes et al. | ..... | 361/816 |
| 6,652,292 | B2 * | 11/2003 | Pratt et al. | ..... | 439/76.1 |
| 6,655,017 | B1 | 12/2003 | Formwalt, Jr. et al. | ..... | 29/832 |
| 6,655,975 | B1 | 12/2003 | Liedtke | ..... | 439/276 |
| 6,705,894 | B1 | 3/2004 | Comerci et al. | ..... | 439/607 |
| 6,735,858 | B1 | 5/2004 | Schmidt | ..... | 29/841 |
| 2003/0162421 | A1 | 8/2003 | Pratt et al. | ..... | 439/76.1 |
| 2004/0095732 | A1 | 5/2004 | Azumi et al. | ..... | 361/752 |
| 2005/0122694 | A1 | 6/2005 | Kane | ..... | 361/752 |

* cited by examiner

*Primary Examiner*—Hien Vu

(57) ABSTRACT

A connector assembly comprising includes a housing with a wall and a plurality of connector units. The wall includes a plurality of openings having the same size and shape. Each of the connector units has a base plate, electrical connectors mounted in and projecting from the base plate, a hollow shroud surrounding the electrical connectors and extending away from the base plate, and a skirt surrounding the shroud. The skirt projects radially outwardly from the base plate. All of the skirts have the same outer peripheral size and shape. The shrouds may have a variety of different outer peripheral shapes and sizes corresponding to unique connector functions. Each of the skirts sealingly engage with a portion of the wall surrounding a corresponding opening. Each opening is surrounded by a groove, and each skirt overlaps and covers a corresponding one of the grooves.

9 Claims, 4 Drawing Sheets

FLEXIBLE ELECTRICAL CONNECTOR/HOUSING ASSEMBLY

BACKGROUND

The present invention relates to an electrical connector assembly.

Electronic controllers used in agricultural, off road vehicle and/or automotive applications are often designed with custom integrated electrical connector features which allow the controller to mate directly with standard, high volume production sealed vehicle wire harness connectors. Staked blades and/or pins are often mounted directly to the printed circuit board in close proximity to the enclosure so that features in the enclosure provide direct support, sealing surfaces and latching means for vehicle wiring harness connectors. For connector integrity, tight manufacturing tolerances are required to make sure that the blades/pins in the circuit board will accurately line up with the integrated connector openings in the electronic controller enclosure. The design requirements for these integrated connector features in the predominately die cast aluminum enclosures can result in high tooling costs. Since customers often demand similar controllers with unique connection requirements, the enclosure designs cannot be reused or standardized to take advantage of high volume production economies of scale.

One such connector assembly is described in published U.S. patent application No. U.S. 2003/01624221. This connector assembly includes a housing which has openings or receptacles which receive header connectors. However, different size header connectors are mounted in corresponding different size receptacles. Thus, different housings would be required for connector assemblies having different sizes and arrangements of header connectors. It is desired to have a connector assembly which permits the use of a standardized housing.

SUMMARY

Accordingly, an object of this invention is to provide an enclosure and connector design which can be standardized.

This and other objects are achieved by the present invention, wherein a die cast enclosure design includes standardized window openings. Grooves around each opening provide an adhesive sealing area. Connectors are molded into individual custom plastic shrouds. Each shroud has a skirt of material around the outside. The skirt has a standard foot print (shape and size) so that any shroud can pass through any window in the enclosure and the skirt of the shroud will provide a sealing surface to the enclosure. In this way a standard enclosure can be configured with a number of connector shroud alternatives, providing a number of connector design configurations for the same enclosure. Each connector shroud is designed to mate with a custom staked pin header so that the printed circuit board and header can be processed through soldering operations without the shrouds in place. After soldering processes have been completed, the individual connector shrouds can be slipped over the pin headers and snapped into the printed circuit board assembly. Tight tolerances between the shroud and the pin header will maintain a positive seal and ensure good connector performance. The adhesive sealant around each window opening in the enclosure will bond to the skirt of each shroud at final assembly.

Several connector shroud and pin header combinations can be designed and tooled up for use in a wide variety of controllers. Since each shroud will have a standard skirt and footprint, it can be substituted in an existing controller design to suit a new customer with unique connector requirements. Die cast enclosures can be reused for new designs or design updates without tooling changes. Prototyping lead time and new design speed to market will be improved.

DETAILED DESCRIPTION

Figure 1:
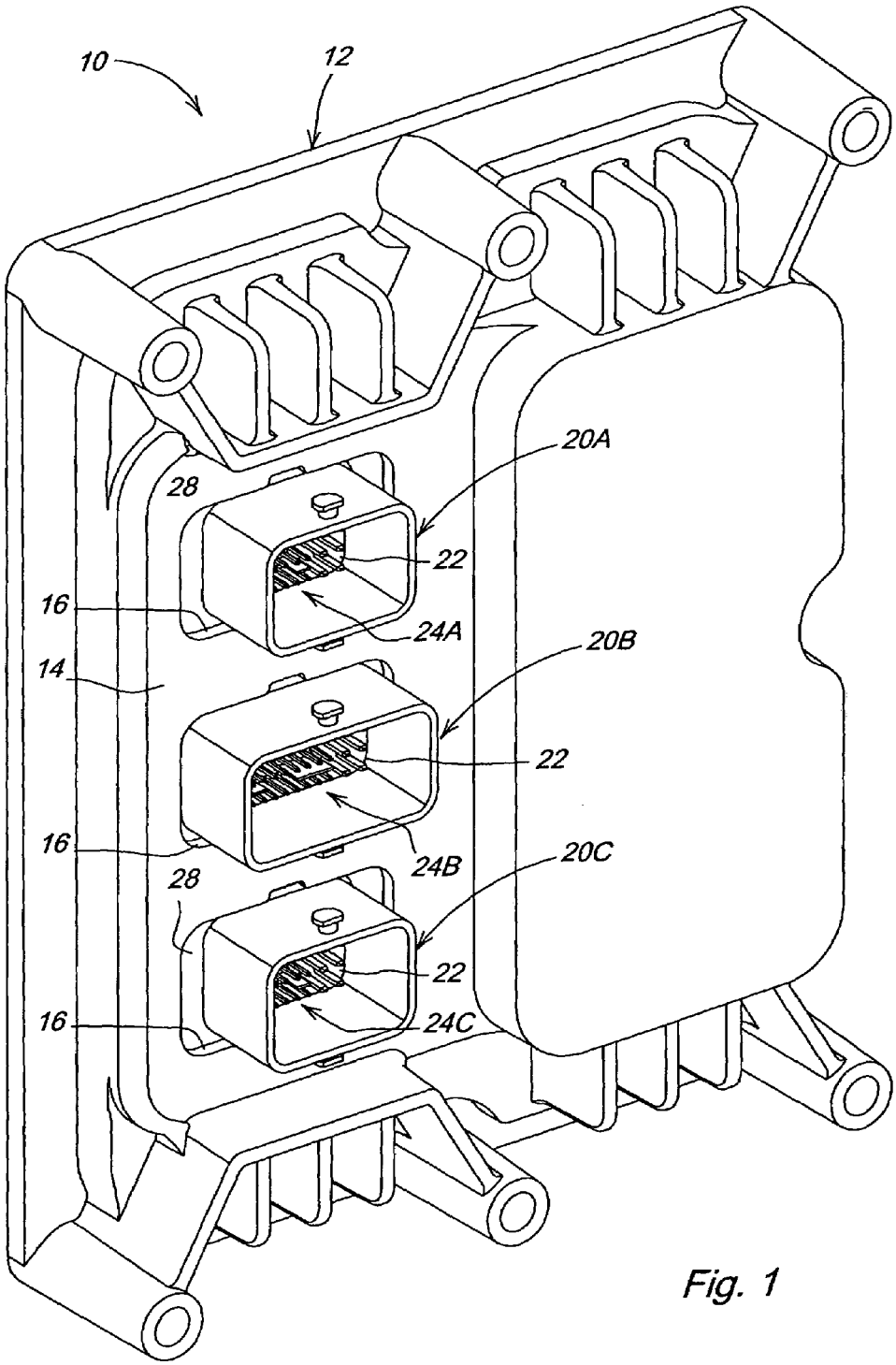
FIG. 1 is a perspective view of a connector assembly according to the present invention.
Figure 2:
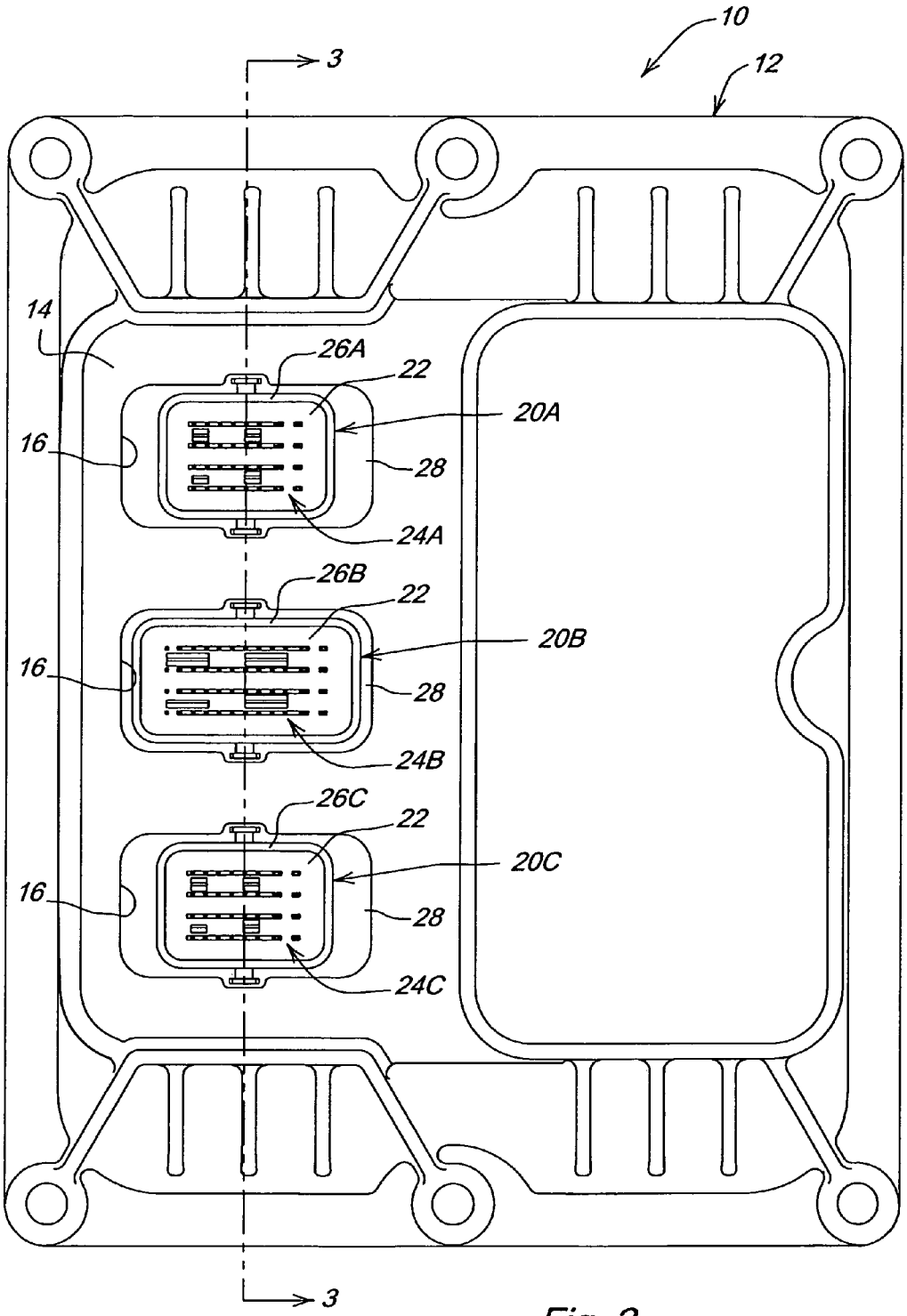
FIG. 2 is an end view of the connector assembly of FIG. 1.
Figure 3:
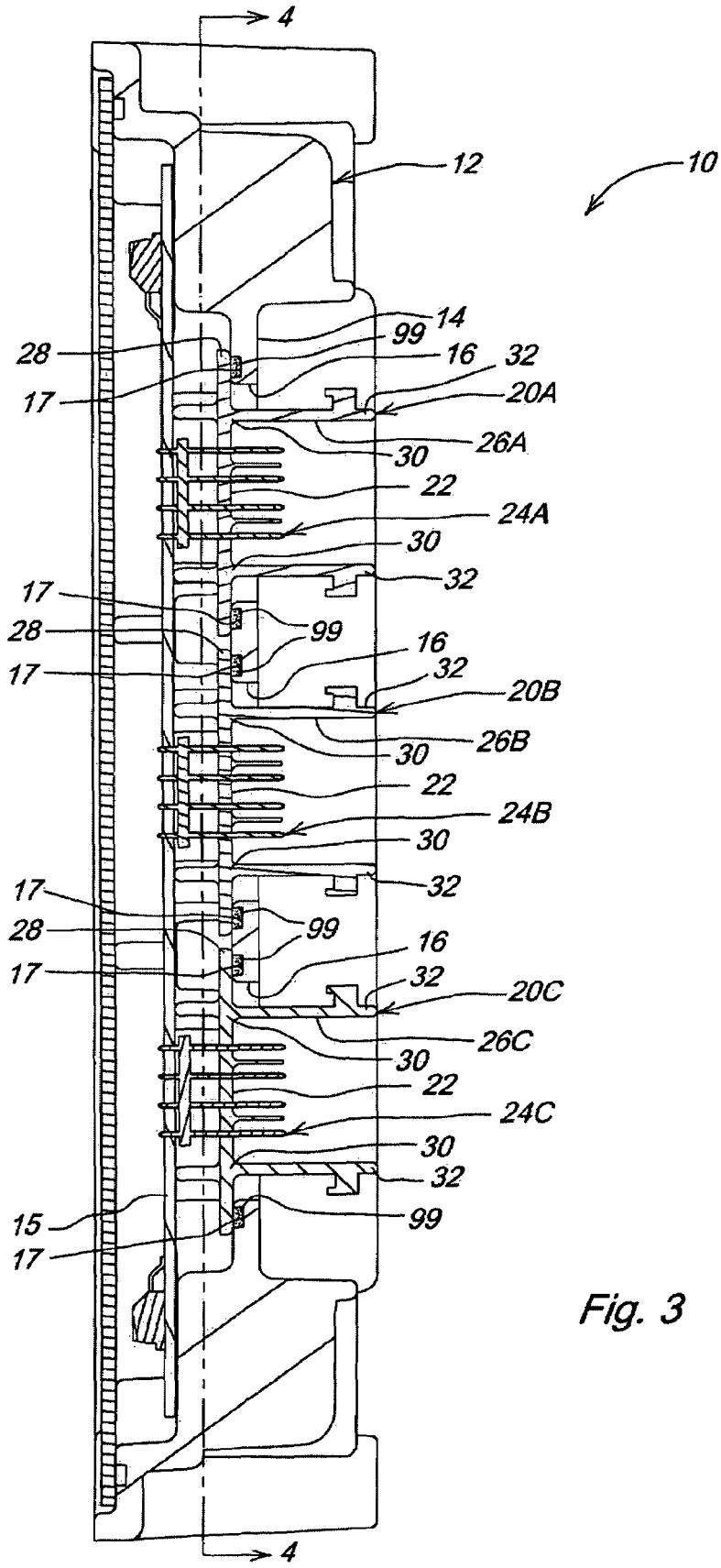
FIG. 3 is a sectional view taken along lines 3-3 of FIG. 2.

Referring to FIGS. 1, 2 and 3, a connector assembly 10 includes an enclosure housing 12 having a wall 14. A plurality of openings or receptacles 16 are formed in the wall 14, all of these openings having the same or common size and shape. As best seen in FIG. 3, each opening 16 is surrounded by a groove 17.

The connector assembly 10 also includes a plurality of connector units 20A, 20B and 20C. Each connector unit 20A-20C has a base plate 22 and an array 24A-24C of electrical connecting elements, such as pins, mounted in and projecting through the base plate 22, a hollow shroud 26A-26C. Each hollow shroud 26A-26C surrounds the corresponding one of the arrays 24A-24C, and extends away from the base plate 22. Each connector unit 20A-20C also includes a peripheral skirt 28 or flange which surrounds the shroud 26A-26C and/or the base plate 22 and which projects radially outwardly therefrom. Each shroud 26A-26C has an inner end 30 joined to the base plate 22 and an open outer end 32. As best seen in FIG. 3, each array of pins 24A-24C is attached to a circuit board 15 which is enclosed in the housing 12. The arrays of pins 24A-24C could be replaced with other types of known conventional electrical connecting elements.

Figure 4:
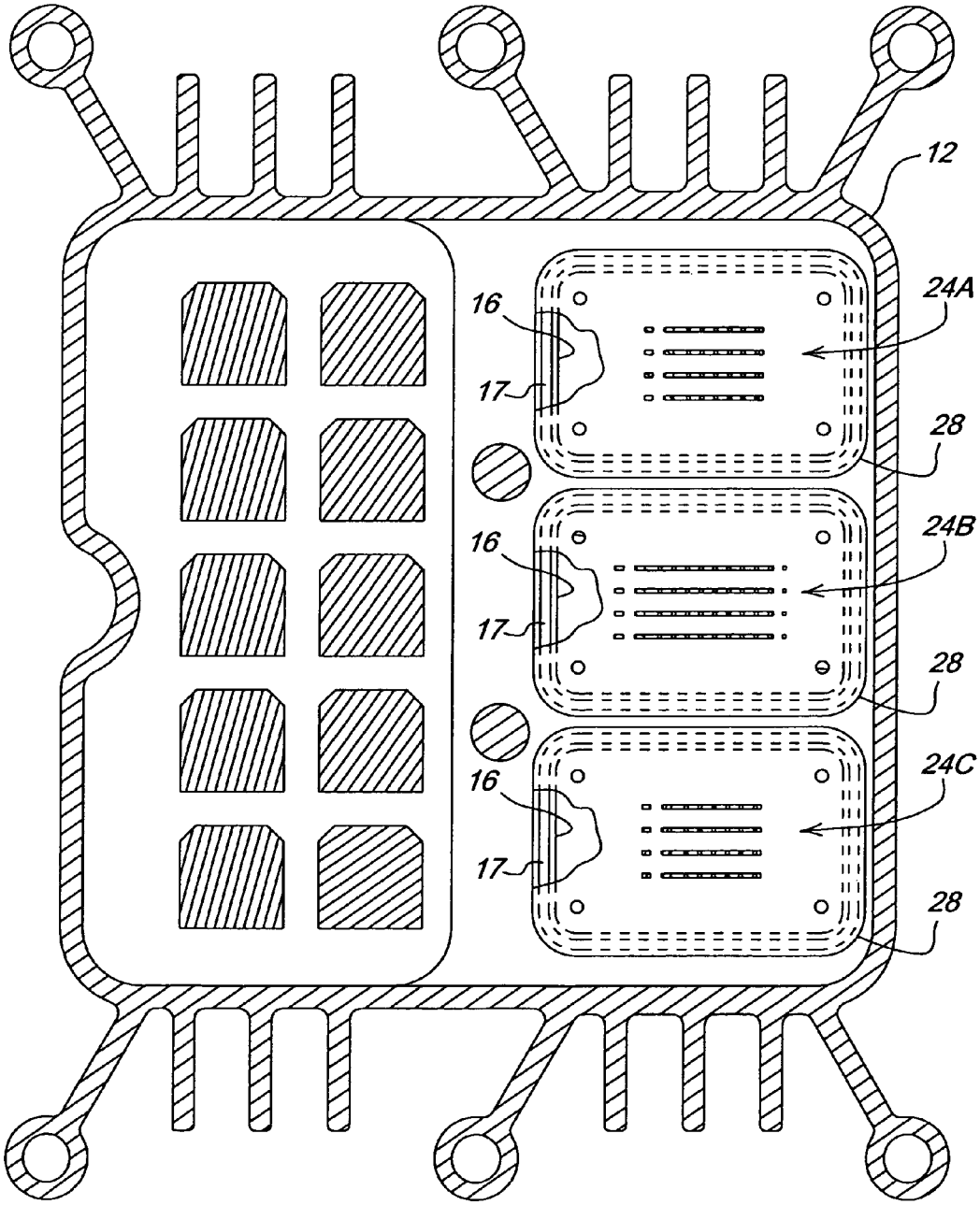
FIG. 4 is a view taken along lines 4-4 of FIG. 3.

As best seen in FIG. 4, all of the skirts 28 have the same outer peripheral size and shape. The shape of the skirts 28 preferably matches the shape of the openings 16. The shape could be substantially rectangular as shown in FIG. 4, but other shapes would also work, such as circular, square, polygonal, etc. The skirts 28 are preferably slightly larger than the size of the openings 16, so that each skirt 28 covers the corresponding groove 17 which surrounds the corresponding opening 16 and so that each skirt engages with adhesive sealant or sealing material (99 in FIG. 3) in the grooves 17. However, as best seen in FIGS. 1 and 2, each or all of the shrouds 26A-26C can have an outer peripheral size and shape which is unique or different from at least some of the other shrouds. For example, shroud 26B has a larger peripheral size than that of shrouds 26A and 26C. Similarly, array 24B includes more pins and extends over a larger area than arrays 24A and 24C. As a result, each one of the connectors 20A-20C can have a particular different and unique size and/or shape which can be associated with or connected to a unique and/or different function or component. Yet, because all the connector units 20A-20C have a skirt 28 with the same outer peripheral size and shape, any one of the connector units 20A-20C can be mounted in any of the common sized openings 16.

While the present invention has been described in conjunction with a specific embodiment, many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A connector assembly comprising:

a circuit board;

an enclosure housing having an upper wall, the upper wall having a plurality of openings formed therein, all of said openings having the same size and shape;

a plurality of connector units, each of the connector units comprising a base plate, spaced from the circuit board an array of pins mounted in and projecting from the base plate, a hollow shroud surrounding the array of pins and extending away from the base plate, and a skirt surrounding the shroud and projecting radially outwardly from the base plate to abut against a bottom face of the upper wall near a respective opening, all of said skirts having the same outer peripheral size and shape corresponding to those of the openings, the shroud of at least one of the connector units having an outer peripheral size and pin configuration which differs from an outer peripheral size and other pin configuration of at least one other of the connector units, each of the skirts sealingly engaging with a portion of the wall surrounding a corresponding one of the openings, each skirt covering a groove in the portion of the wall and engaging with a sealing material in the groove; wherein the skirts of the connector units are held captive between the upper wall of the housing and the circuit board.

2. The connector assembly of claim 1, wherein:

the array of pins of at least one of the connector units differs from the array of pins of at least one other of the connector units.

3. The connector assembly of claim 1, comprising:

the skirts have a generally rectangular outer shape.

4. The connector assembly of claim 1, wherein:

the wall has a plurality of grooves formed therein, each groove surrounding a corresponding one of the openings.

5. The connector assembly of claim 4, wherein:

each skirt overlaps and covers a corresponding one of the grooves.

6. The connector assembly of claim 1, wherein:

the skirts and the openings have a generally rectangular shape.

7. A connector assembly comprising:

a circuit board;

a housing having an upper wall, the upper wall having a plurality of openings formed therein, all of said openings having the same size and shape;

a plurality of connector units, each of the connector units comprising a base plate, spaced from the circuit board an array of electrical connecting elements mounted in and projecting from the base plate, a hollow shroud surrounding the array and extending away from the base plate, and a skirt surrounding the shroud and projecting radially outwardly from the base plate to abut against a bottom face of the upper wall near a respective opening, all of said skirts having the same outer peripheral size and shape corresponding to those of the openings, the shroud of at least one of the connector units having an outer peripheral size and pin configuration which differs from an outer peripheral size and other pin configuration of at least one other of the connector units, each of the skirts engaging with a portion of the wall surrounding a corresponding one of the openings, each skirt covering a groove in the portion of the wall and engaging with a sealing material in the groove; wherein the skirts of the connector units are held captive between the upper wall the housing and the circuit board.

8. The connector assembly of claim 7, comprising:

the array of at least one of the connector units differs from the array of at least one other of the connector units.

9. The connector assembly of claim 7, wherein:

the array of electrical connecting elements comprises an array of pins mounted in and projecting from the base plate.

* * * * *